US006286146B1

(12) United States Patent
Rocker

(10) Patent No.: US 6,286,146 B1
(45) **Date of Patent: *Sep. 11, 2001**

(54) METHOD OF WEARING WEIGHTED TRAINING VEST WHILE LISTENING TO AUDIO EQUIPMENT

(76) Inventor: Debra Rocker, 14330 Ventura Blvd., Sherman Oaks, CA (US) 91423

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/439,487

(22) Filed: Nov. 15, 1999

(51) Int. Cl.[7] ..... A41D 3/02; A63B 21/65
(52) U.S. Cl. ..... 2/94; 2/102; 482/105
(58) Field of Search ..... 2/102, 93, 94, 2/2.5, 455, 463, 456, 467, 462, 247–252, DIG. 1, 273, 108, 69; 482/105, 120

(56) References Cited

U.S. PATENT DOCUMENTS

| | | | | |
|---|---|---|---|---|
| 4,268,917 | | 5/1981 | Massey . | |
| 4,382,302 | | 5/1983 | Watson . | |
| 4,637,075 | * | 1/1987 | Ingrisano et al. | 2/94 |
| 4,658,442 | | 4/1987 | Tomlinson et al. . | |
| 4,825,471 | * | 5/1989 | Jennings | 2/94 |
| 4,876,724 | * | 10/1989 | Suzuki | 2/94 |
| 4,989,267 | * | 2/1991 | Watson | 2/102 |
| 5,002,270 | * | 3/1991 | Shine | 2/102 |
| 5,127,565 | * | 7/1992 | Grant | 2/94 |
| 5,265,782 | * | 11/1993 | McNamara | 2/94 |
| 5,361,412 | * | 11/1994 | Perry | 2/94 |
| 5,617,582 | * | 4/1997 | Burwell | 2/102 |
| 5,768,706 | * | 6/1998 | Griffith et al. | 2/102 |
| 5,774,338 | * | 6/1998 | Wessling | 361/730 |
| 5,810,699 | * | 9/1998 | Nadeau | 482/105 |
| 5,907,869 | * | 6/1999 | Bohn et al. | 2/102 |
| 5,937,441 | * | 8/1999 | Raines | 482/105 |
| 5,943,700 | * | 8/1999 | Hammer et al. | 2/94 |
| 6,097,822 | * | 8/2000 | Min | 2/102 |

* cited by examiner

*Primary Examiner*—John J. Calvert
*Assistant Examiner*—Tejash Patel
(74) *Attorney, Agent, or Firm*—Trojan Law Offices

(57) ABSTRACT

A weighted exercise vest is adapted for wearing on the upper body of a person. The vest has front and rear compartments in which multiple weights may be inserted. The compartments securely hold the weights therein when the wearer is engaged in physical activity. The weight-containing compartments, according to one or more embodiments of the invention, are formed as elongated tubular ribs or pockets and are located across the back, front or sides of the vest. The vest, in a particularly preferred embodiment, also includes a single pocket advantageously located on the upper back portion of the vest, sized to fit other equipment, such as a portable CD or cassette tape player. The outer surface of the weight-containing compartments or pockets is made from elastic material or includes elastic lining or bands to snugly hold the weights or other equipment inserted therein. In a certain embodiments of the invention, the vest has air-pervious panels, for example on the left and right sides, to allow for air circulation between the body of the wearer and the vest.

1 Claim, 4 Drawing Sheets

METHOD OF WEARING WEIGHTED TRAINING VEST WHILE LISTENING TO AUDIO EQUIPMENT

BACKGROUND OF THE INVENTION

1. Field of the Invention

This invention relates in general to an exercise vest and, more particularly, to a weighted training vest adapted for wearing during physical activities such as walking or hiking by persons interested in increasing their strength and endurance.

2. Description of Related Art

It is common for athletes interested in developing greater strength, muscle tone or endurance to carry additional weight on their body in one manner or other. For example, some athletes carry additional weight in the form of dumbbells while walking, jogging or doing aerobics; others wear weights around their wrists, ankles or waist at all times or during specific physical activities.

Typically, the relative number of calories burnt and the degree of muscle strengthening that occurs during a physical activity depends on the resistance that muscles have to overcome. Carrying added weight imposes greater resistance upon the leg muscles, as well as other muscles involved in a physical activity, thus strengthening them. Furthermore, to overcome the additional resistance exerted by the weights, more calories need to be burned to allow the muscles to work harder. Therefore, the added resistance also helps a person to burn more calories and loose body fat. Increased muscle strength and less body fat is a sign of greater fitness and physical well being.

Conventional methods of weight training include confined movements that work isolated groups of muscles. This can possibly result in an imbalance in muscle strength and can increase the chance of injury. For a balanced increase in muscle strength, it is preferred that the strengthening is accomplished by adding weight to a person's body while exercising in a natural manner. Further, it is desirable for the weight to be evenly distributed about the body and gradually added in variable, progressive and controlled increments. Thus, a training device is needed that can help strengthen all muscles involved in walking, or hiking, in a naturally balanced and controlled manner.

While weighted training vests have, in the past, been used to impose increased muscle resistance above the waist, such vests have suffered from several deficiencies. For example, the weights carried in the prior art vests have the tendency to bounce around, constituting a source of discomfort to the wearer. Furthermore, they fail to provide a means for incrementally increasing the carried weight that distributes the weight evenly and uniformly about the wearer's body. The prior art training vests can become uncomfortably heavier on one side or the other, thereby throwing off the wearer's balance, rhythm and concentration. An additional shortcoming of some conventional vests is that vigorous movement by the wearer causes the weights to shift position or even fall out of the vest. Further, most prior art training vests fail to include additional compartments that allow the wearer to carry equipment other than the weights.

Thus, an improved training vest is needed that can comfortably and safely hold a variable number of weights and other equipment in a fixed position relative to the wearer's body, such that the total weight of the vest is evenly distributed around the body of the wearer, and so that weight can be incrementally added or removed as needed.

SUMMARY OF THE PREFERRED EMBODIMENTS

The invention is directed to a weighted exercise vest adapted for wearing on the upper body of a person during walking, hiking or similar physical activities. The vest has front and rear compartments in which multiple weights may be inserted. The compartments securely hold the weights therein when the wearer is engaged in physical activity. In one or more embodiments of the invention, the compartments are designed to hold individual weights and are uniformly spaced apart to allow for the weights to be selectively and evenly distributed around the body of the wearer in predetermined positions. The compartments snugly fit the weights inserted therein and include fasteners to prevent them from bouncing around, falling out or changing position during physical activity.

According to one or more embodiments of the invention, the weight-containing compartments are formed as elongated tubular ribs or pockets and are located across the back, front or sides of the vest. In particularly preferred embodiments, the vest also includes a single pocket sized to fit other equipment such as a portable CD or cassette tape player. The pocket might advantageously be located on the upper back portion of the vest. Additionally, the pocket preferably is closable by a single flap which may be fastened by a button, zipper, buckle or other means equivalent in function or structure.

Preferably, the vest is made of fabric or other suitable material that can be worn comfortably around the mid-torso of a person. In some embodiments, the outer surface of the weight-containing compartments or pockets is made from elastic material or includes elastic lining or bands to snugly hold the weights or other equipment inserted therein. In one or more embodiments of the invention, the vest has air-pervious panels, for example on the left and right sides, to allow for air circulation between the body of the wearer and the vest.

In one or more embodiments of the invention, one or more straps, including fasteners commonly used in the art, are utilized to fasten and adjust the vest to the body of the wearer. One or more embodiments of the invention include additional adjusting means, for example on the sides of the vest, to allow for readjusting the size of the vest for a comfortable fit. The above features and other advantages of the present invention will be more readily understood by those of ordinary skill in the art upon reading the detailed description of the preferred embodiments of the invention, taken in conjunction with the appended drawings and the ensuring claims.

DESCRIPTION OF THE PREFERRED EMBODIMENTS

Figure 1:
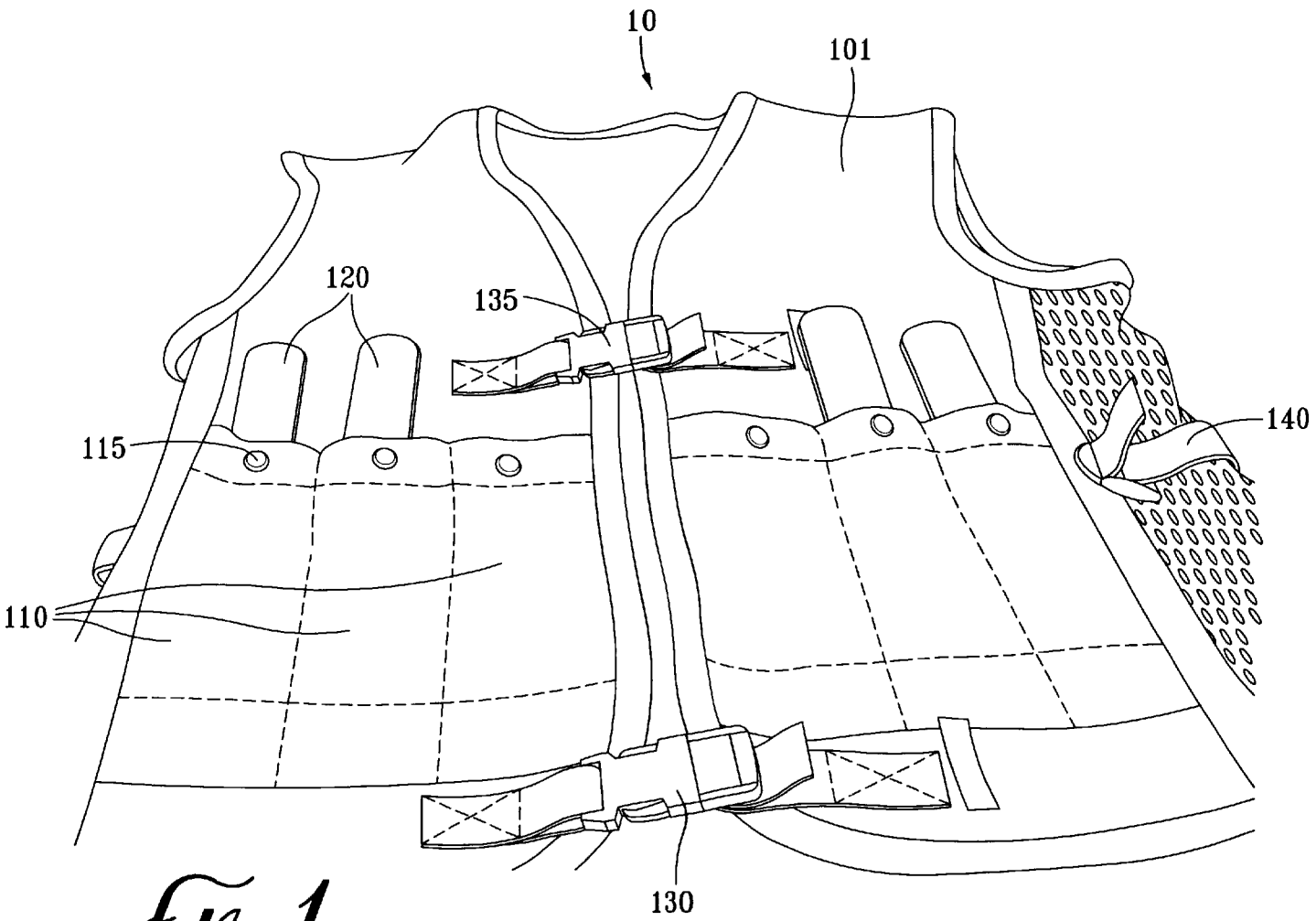
FIG. 1 is a front view of a weighted training vest, according to one or more embodiments of the invention.
Figure 2:
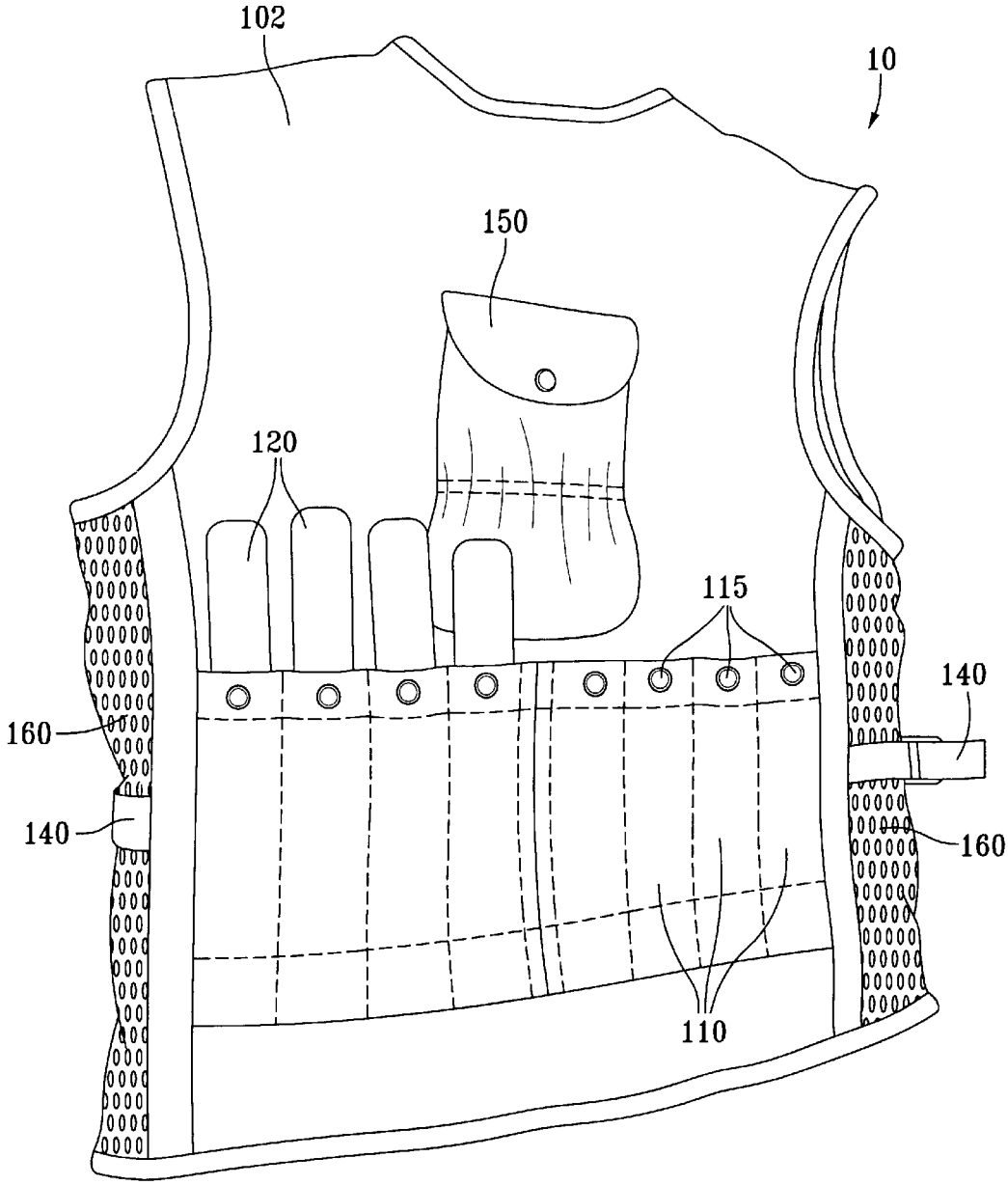
FIG. 2 is a back view of the vest of FIG. 1.
Figure 4:
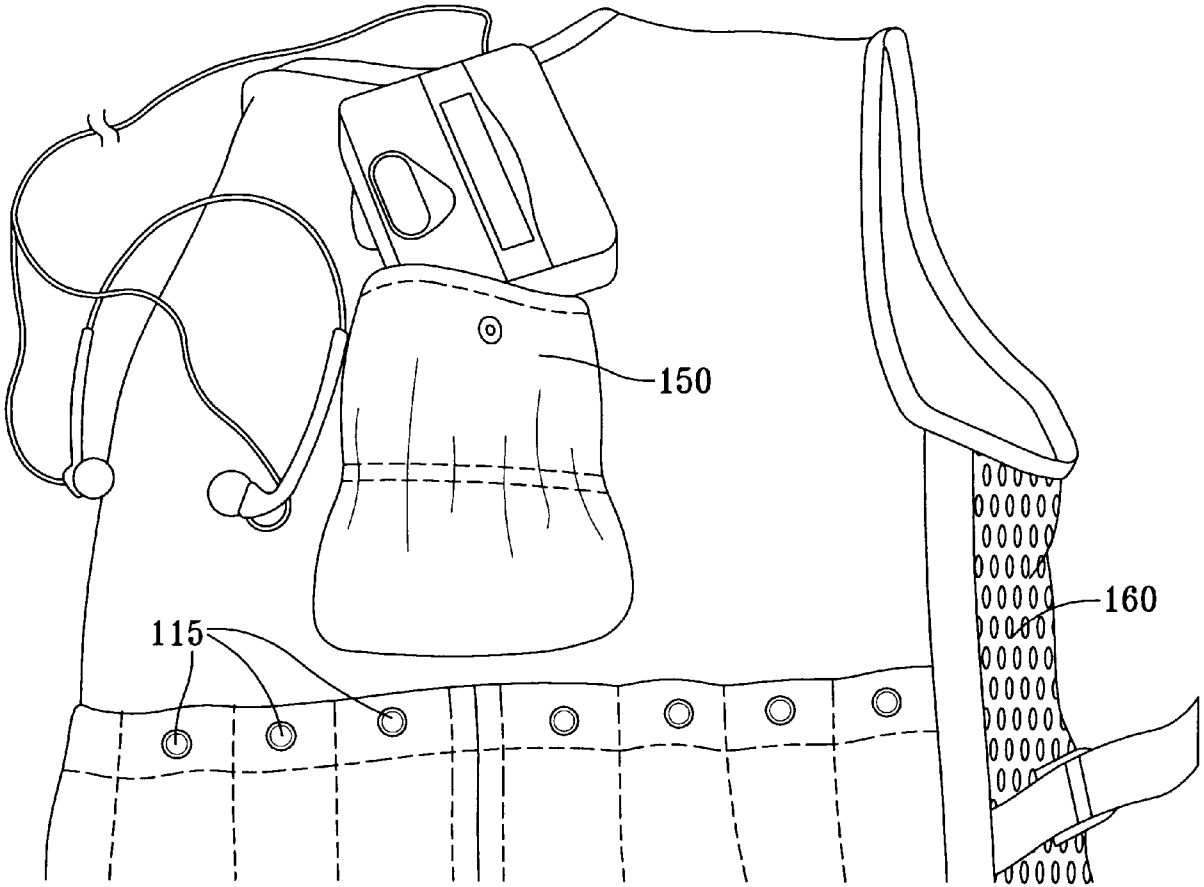
FIG. 4 is a back view of the single pocket design of the vest of FIG. 1 used in connection with a portable audio cassette tape player, according to one or more embodiments of the invention.

A weighted training vest according to one or more embodiments of the invention, indicated generally as 10, is illustrated in FIG. 1. Vest 10 includes at least a front panel 101 and a back panel 102 (not shown in FIG. 1). In a preferred embodiment of the invention, front panel 101 has right and left panels joined at the shoulders and the sides to back panel 102 to form a single wearable item. Vest 10 includes openings for the arms of a person to extend through, having a shape as illustrated in FIGS. 1, 2 and 4. Panels 101 and 102 are preferably made of fabric or other suitable material. As illustrated in FIG. 2, in one or more embodiments of the invention, air-pervious side panels 160 are included to allow air to circulate in and out of vest 10 while it is worn by a person. Side panels 160 can be made of elastic or other material and can, for example, have an open mesh configuration resembling a bee-hive pattern with rounded openings.

As illustrated in FIG. 1, adjustable interconnecting means 130 and 135 are utilized to adjustably fasten the left and right panels of vest 10 together. Interconnecting means 130 and 135 can include adjustable tightening straps and pressure-activated fasteners so as to hold front and back panels snugly in contact with the wearer's chest and back while the vest is being worn. The fasteners can take the form of any mutually cooperating fastening means such as zippers, buttons, hooks or loops or other functionally or structurally equivalent fasteners. A particularly preferred configuration of a training vest uses a fastener or buckle assembly, as illustrated in FIG. 1, including a male element providing opposing resilient tangs that engage openings within a matched receiving element. Preferably the receiving element has a rectangular cross-section with open sides so that the receiving element latchably engages projections laterally extending from the outer faces of the tangs. The illustrated fastener is particularly preferred as mechanically strong, simple to operate even while wearing gloves, and inexpensive to implement for the training vest. One or more embodiments of the invention also include adjusting straps 140 on each side of vest 10, which allow the wearer to easily adjust the size of vest 10 for a comfortable fit.

Figure 3:
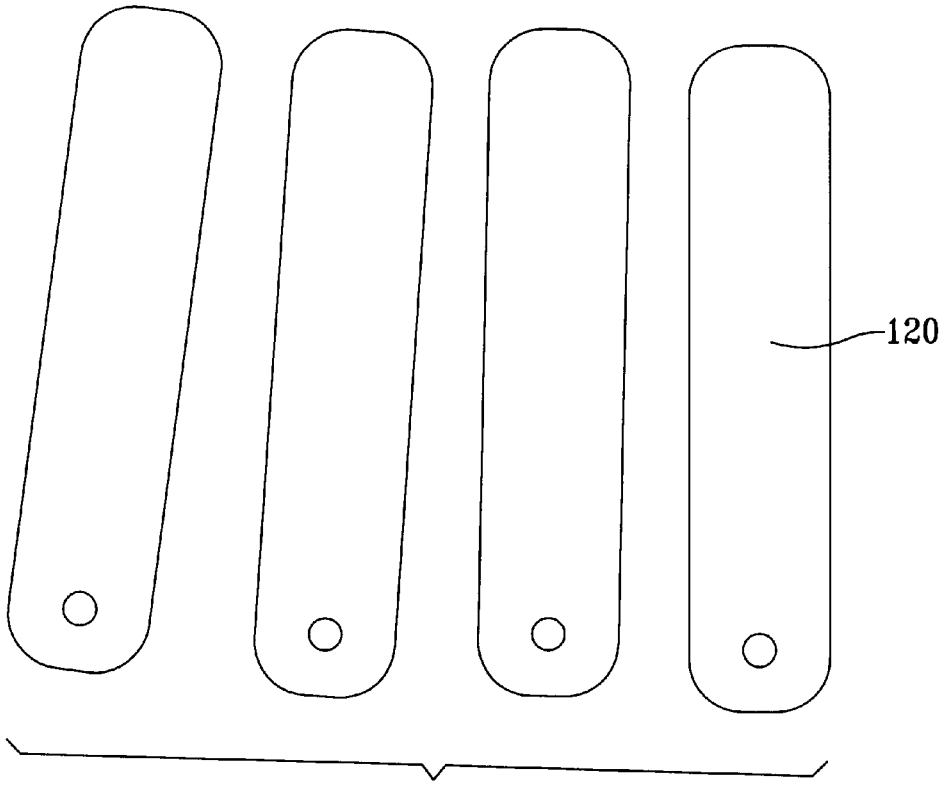
FIG. 3 is a top view of a set of exemplary weights used in connection with the invention.

Referring to FIGS. 1 and 2, front and back panels 101 and 102 include compartments 110, symmetrically positioned about a centerline of vest 10. In one or more embodiments of the invention, compartments 110 are of uniform size for receiving weights of uniform size and configuration. This arrangement allows for weights 120 to be evenly distributed around vest 10 for better balance and comfort. An exemplary set of various weights 120, suitable for use with embodiments of the invention, is illustrated in FIG. 3. Individual weights 120 can have various colors so that they are aesthetically more appealing or to indicate their weights so a user can easily distinguish between a heavier and a lighter weight.

As shown in FIGS. 1 and 2, certain preferred embodiments of the invention include a plurality of tubular elongated compartments 110 extending vertically along front and back panels 101 and 102. The tubular compartments 110 are defined by vertically extending columns of stitches. Each compartment 110 is sewn shut along the edge of the panels and includes an opening on the upper end forming a tubular pocket for receiving elongated weights 120. The openings include mutually cooperative fasteners 115, such as hook and loop fastening material, push engaged buttons or snaps to snugly retain weights 120 inside and to prevent weights 120 from being displaced or dislodged during physical activity.

During use, vest 10 is fastened to the wearer's upper body, preferably around the mid-torso area, via interconnecting means 135 and 130, so that panels 101 and 102 are held snug against the wearer's chest and back without impairing the wearer's breathing. For a comfortable fit, adjustable straps 140 can be loosened or tightened easily by pulling on the adjusting mechanism attached thereto. The number of individual weights 120 inserted in compartments 110 can be adjusted by the wearer depending on the nature of the anticipated training program. For example, novice trainees may want to use a substantially lighter set of weights and gradually increase the number of weights as they continue their training. Weights 110 are preferably added in a balanced fashion with respect to front and rear panels, such that the overall weight is uniformly distributed from side-to-side and about the body of the wearer.

A person can engage in various physical activities, including walking or hiking, while wearing vest 10. The added resistance provided by wearing the vest 10 strengthens the muscles of the wearer in a natural and balanced manner. In addition to the development of muscle strength, the added resistance created by wearing vest 10 helps the wearer bum more calories while walking or hiking. Vest 10, in one or more embodiments, can include various logos or designs displayed on the front or back panels for appearance.

In addition, in a preferred embodiment of the invention, vest 10 includes a single pocket 150 located on the upper portion of back panel 102 sized to fit other equipment such as an audio CD or cassette tape player, as illustrated in FIG. 4. Thus, a person wearing vest 10 can easily and comfortably carry an audio player inside back pocket 150 and enjoy listening to music while training. In a certain preferred embodiment of the invention, single pocket 150 is easily accessible because it is advantageously located on the upper portion of back panel 102.

When an audio CD or cassette tape player is stored in back pocket 150, the wiring that connects the headphone to the body of the audio player is conveniently and loosely positioned behind the wearer. This positioning is especially advantageous because it keeps the wiring out of the wearer's face and front body portions, thereby preventing it from disturbing the wearer or getting entangled around his or her body parts while he or she is engaged in physical activity. In one or more embodiments of the invention, pocket 150 is closable by a single flap which may be fastened by a fastener to the outer surface of pocket 150. The outer surface of pocket 150 or compartments 110, in some embodiments, is made of elastic material or, in the alternative, includes elastic lining or bands to snugly hold weights 120 or other equipment inserted therein.

While only a number of embodiments consistent with the present invention have been described, those skilled in the art will understand that various changes and modifications may be made to these embodiments, and equivalents may be substituted for elements in these embodiments, without departing from the true scope of the invention. In addition, modifications may be made to adapt a particular element, technique or implementation to the teachings of the present invention without departing from the central scope of the invention. Therefore, this invention should not be limited to the particular embodiments and methods disclosed in this application, but should include all embodiments that fall within the scope of the appended claims.

I claim:

1. A method of weight training and listening to audio equipment connected to ear phones by wires comprising, providing a weight vest having left, right and rear panels, providing each of said panels with side edges proximal to the wearer's sides and top edges proximal to the wearer's shoulders, adjustably connecting left and right panels to the rear panel at said side and top edges, providing a plurality of elongated compartments about the front and rear panels, for receiving one or more weights, providing a front fastening means attached to the front panel, for adjustably fastening the vest about the body, and providing side adjusting means, for adjusting the size of the vest for a comfortable fit, said weight training vest having a pocket sized to fit audio equipment, said pocket located in the upper center portion of the rear panel above said elongated compartments, providing said pocket with a flap overlay with fastening means to cover said pocket and secure said audio equipment preventing said audio equipment from being dislodged from said pocket, providing said pocket with an elastic stretchable means to restrict the movement of said audio equipment within said pocket, the method further including the steps of:

inserting audio equipment in said rear pocket a sufficient distance to insure that said elastic means is holding the audio equipment in place;

extending said wires and ear phones from said pocket;

securing said fastening means of said flap;

donning said weight training vest about the body of a person;

disposing weights uniformly in the plurality of elongated compartments, the total weight of the weights disposed in the compartments about the front panel being about the total weight of the weights disposed in the compartments about the rear panel;

fastening the front fastening means to fasten the vest about the body;

adjusting the front fastening means to prevent the weights from excessively jogging while weight training for a comfortable fit;

adjusting the side adjusting means to adjust the size of the vest to prevent the weights from excessively jogging while weight training for a comfortable fit;

securing said ear phones over said ears; and, exercising while listening to said audio equipment.

* * * * *